US007986204B2

(12) United States Patent
Mader et al.

(10) Patent No.: US 7,986,204 B2
(45) Date of Patent: Jul. 26, 2011

(54) RELAY WITH A CONTACT ARRANGEMENT CONSISTING OF CONTACT SPRINGS

(75) Inventors: Leopold Mader, Moedling (AT); Philipp Zeitlberger, Horn (AT)

(73) Assignee: Tyco Electronics Austria GmbH, Vienna (AT)

( * ) Notice: Subject to any disclaimer, the term of this patent is extended or adjusted under 35 U.S.C. 154(b) by 111 days.

(21) Appl. No.: 11/774,627

(22) Filed: Jul. 9, 2007

(65) Prior Publication Data

US 2008/0030288 A1 Feb. 7, 2008

(30) Foreign Application Priority Data

Aug. 4, 2006 (DE) ..... 10 2006 036 613

(51) Int. Cl.
*H01H 51/22* (2006.01)

(52) U.S. Cl. ..... 335/78; 335/83

(58) Field of Classification Search ..... 335/78, 335/129, 130, 83
See application file for complete search history.

(56) References Cited

U.S. PATENT DOCUMENTS

| | | | | |
|---|---|---|---|---|
| 4,398,165 | A | 8/1983 | Iketani | |
| 4,616,201 | A | 10/1986 | Nagamoto | |
| 4,761,627 | A * | 8/1988 | Bell | 335/128 |
| 4,910,484 | A * | 3/1990 | Shikano et al. | 335/61 |
| 5,151,675 | A * | 9/1992 | Biehl et al. | 335/78 |
| 5,204,647 | A | 4/1993 | Mitsuki et al. | |
| 5,392,015 | A * | 2/1995 | Matsuoka et al. | 335/78 |
| 5,497,132 | A * | 3/1996 | Mader | 335/78 |
| 5,719,541 | A * | 2/1998 | Mader | 335/78 |
| 5,748,061 | A * | 5/1998 | Tsutsui et al. | 335/83 |
| 5,864,270 | A * | 1/1999 | Hoffman | 335/78 |
| 5,907,268 | A * | 5/1999 | Mader | 335/202 |
| 5,982,257 | A * | 11/1999 | Vernier | 335/78 |
| 5,990,770 | A * | 11/1999 | Doneghue | 335/78 |
| 6,023,212 | A | 2/2000 | Mader | |
| 6,111,487 | A * | 8/2000 | Hoffmann et al. | 335/78 |
| 6,606,018 | B2 * | 8/2003 | Takano et al. | 335/78 |
| 6,621,394 | B2 * | 9/2003 | Ono et al. | 335/159 |
| 6,765,462 | B2 * | 7/2004 | Noguchi | 335/128 |
| 6,816,044 | B2 * | 11/2004 | Mader et al. | 335/129 |
| 6,873,232 | B2 * | 3/2005 | Chida et al. | 335/78 |
| 6,903,638 | B2 * | 6/2005 | Nakamura et al. | 335/78 |
| 6,903,639 | B2 * | 6/2005 | Sanada et al. | 335/129 |
| 6,933,815 | B2 * | 8/2005 | Saruwatari et al. | 335/78 |
| 7,205,870 | B2 * | 4/2007 | Sanada et al. | 335/78 |
| 7,283,026 | B2 * | 10/2007 | Nakamura et al. | 335/78 |
| 7,358,839 | B2 * | 4/2008 | Mikl | 335/78 |
| 2002/0036557 | A1 * | 3/2002 | Nakamura et al. | 335/128 |
| 2002/0109569 | A1 * | 8/2002 | Yamashita et al. | 335/129 |
| 2005/0057332 | A1 * | 3/2005 | Nakamura et al. | 335/128 |

FOREIGN PATENT DOCUMENTS

| | | |
|---|---|---|
| WO | WO 98/50933 | 11/1998 |

* cited by examiner

*Primary Examiner* — Anh T Mai
*Assistant Examiner* — Alexander Talpalatskiy
(74) *Attorney, Agent, or Firm* — Barley Snyder LLC

(57) ABSTRACT

A relay has a main body with a base. An electromagnetic switching mechanism is arranged on the base. A contact arrangement includes at least one stationary contact spring and at least one moveable contact spring arranged on a first side of the main body. The moveable contact spring has a first portion extending substantially perpendicular to the base that is actuatable by the electromagnetic switching mechanism and a second portion extending substantially parallel to the base that extends from the first side of the main body to an opposing second side of the main body. A terminal contact extends from the second portion on the second side of the main body.

16 Claims, 6 Drawing Sheets

RELAY WITH A CONTACT ARRANGEMENT CONSISTING OF CONTACT SPRINGS

CROSS-REFERENCE TO RELATED APPLICATIONS

This application claims the benefit of the filing date under 35 U.S.C. §119(a)-(d) of German Patent Application No. DE 10 2006 036 613.1, filed Aug. 4, 2006.

FIELD OF THE INVENTION

The present invention relates to a relay with an electromagnetic switching mechanism and a contact arrangement wherein the contact arrangement includes at least one stationary contact spring and at least one moveable contact spring arranged on a first side of the main body and the moveable contact spring has a terminal contact extending from an opposing second side of the main body.

BACKGROUND

A typical switching apparatus in the form of a relay comprises a contact switching device, which generally includes a stationary contact element and a moveable contact element. Usually, the stationary contact element and the moveable contact element are in the form of contact springs. A switching mechanism acts of the moveable contact element. The switching mechanism brings the moveable contact element into contact with the stationary contact element or moves the moveable contact element away from the stationary contact element so that a switching operation or a changeover operation occurs. The relay comprises a magnet frame with a core passing through a coil. The magnet frame forms a pole face with which an armature interacts. The armature is connected to the moveable contact element, for example, by an actuating member or coupling element so that the armature acts on the moveable contact element. The above-described relay is mounted on a printed circuit board, which requires the relay to have a specific design and a specific component type. For example, the relay is required to be formed in a miniature size while still being inexpensive to produce. The miniature size is required because limited structural space is available on the printed circuit board. On the other hand, it is a requirement that comparatively high powers be achievable with the relay.

An example of a relay design which is suitable for the above-described purpose is knows as a so-called "sugar cube" relay. This relay takes the form, in particular, of a changeover relay that has two exciting coil contacts, three contact terminals for the changeover function in the form of a make contact, a break contact, and a changeover contact. In the case of a relay of this design, a terminal pin for the changeover contact is arranged between the two exciting coil contacts, while the contact terminals for the make contact and the break contact are arranged on an opposite side of the main body of the relay. However, it is desirable, in particular with regard to production costs, to provide a relay for the above-described application that can be produced even more cheaply than the relay of the above-described "sugar cube" design.

BRIEF SUMMARY

It is therefore an object of the present invention to provide a relay which is inexpensive to produce and is compatible with a printed circuit board with a terminal configuration of the above-described type.

This and other objects are achieved by a relay comprising a main body with a base. An electromagnetic switching mechanism is arranged on the base. A contact arrangement includes at least one stationary contact spring and at least one moveable contact spring arranged on a first side of the main body. The moveable contact spring has a first portion extending substantially perpendicular to the base that is actuatable by the electromagnetic switching mechanism and a second portion extending substantially parallel to the base that extends from the first side of the main body to an opposing second side of the main body. A terminal contact extends from the second portion on the second side of the main body.

DETAILED DESCRIPTION OF THE EMBODIMENT(S)

Figure 2:
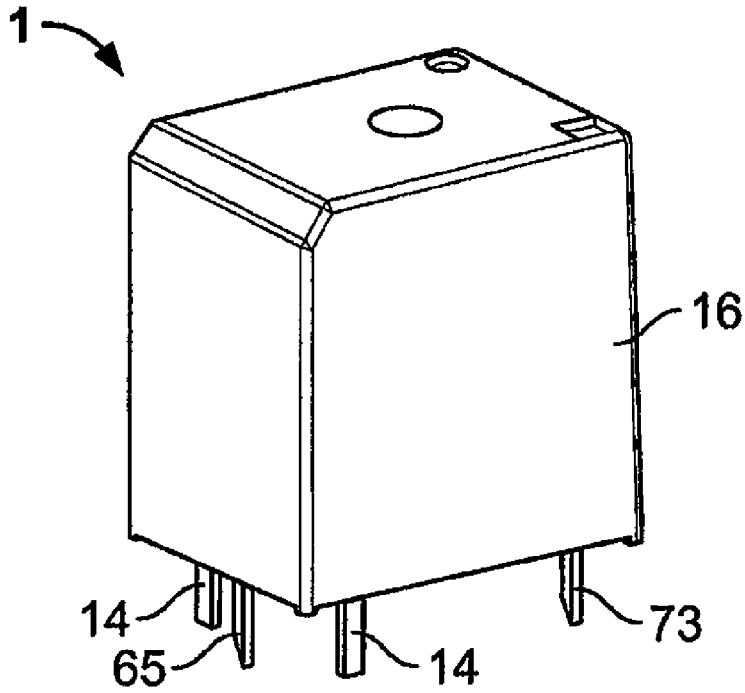
FIG. 2 is a perspective view of a relay according to an embodiment of the invention.
Figure 3:
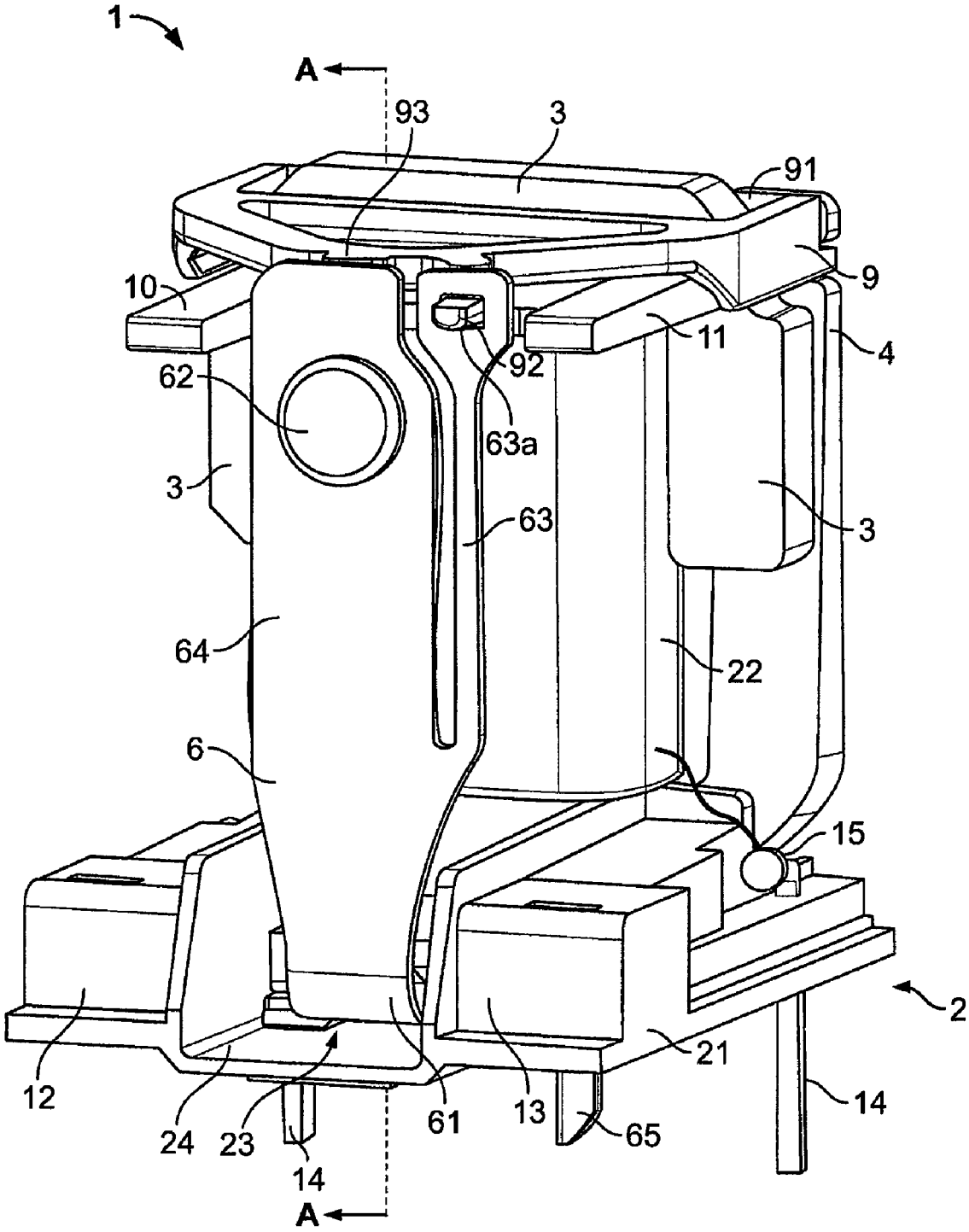
FIG. 3 is a perspective view of the relay of FIG. 2 shown without an external housing.

FIGS. 2-7 show a relay 1 according to an embodiment of the invention. As shown in FIGS. 2-3, the relay 1 comprises a main body 2 substantially surrounded by an external housing 16. As shown in FIG. 3, the main body 2 includes a base 21 provided with an electromagnetic switching mechanism consisting of a core 3, an armature 4, an actuating member 9, and a coil 22. The coil 22 is arranged substantially perpendicularly to the base 21. The core 3 passes through a coil former of the coil 22. The core 3 is arranged with a middle leg inside the coil former and lateral legs arranged on opposite sides of the coil former. The core 3 may be, for example, substantially T-shaped or M-shaped. The actuating member 9 extends substantially parallel to the base 21. A top portion of the actuating member 9 surrounds a top of the core 3 and is provided with a frame-like recess 91 that receives the top of the core 3. The actuating member 9 is guided by lateral guides along an upper flange of the main body 2. A projection 93 extends from the actuating member 9. This actuating member 9 transmits movement of the armature 4 to a moveable contact spring 6. The above-described relay arrangement is substantially known from WO 98/50933 A.

Figure 4:
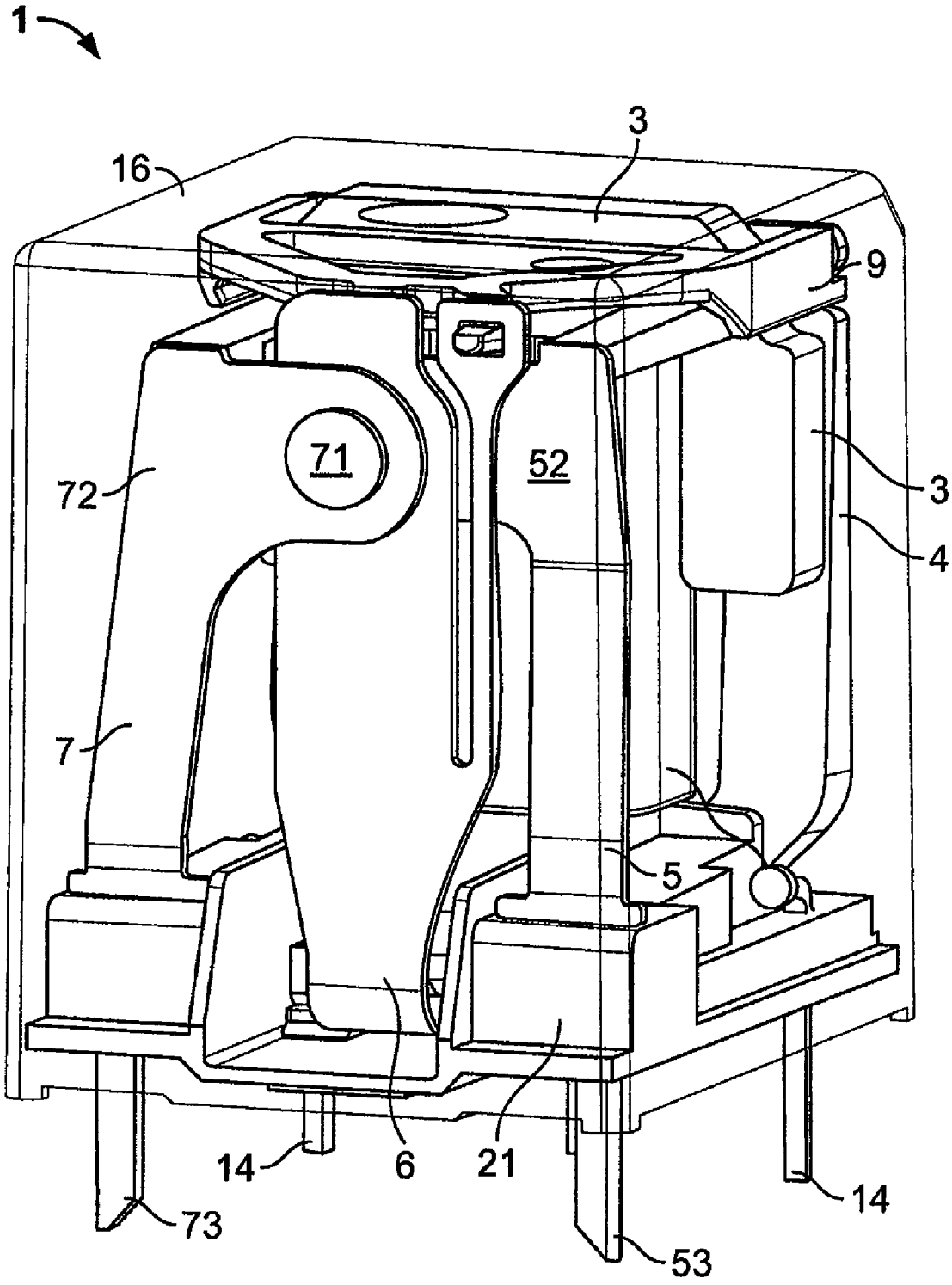
FIG. 4 is a schematic illustration of the relay of FIG. 2.
Figure 5:
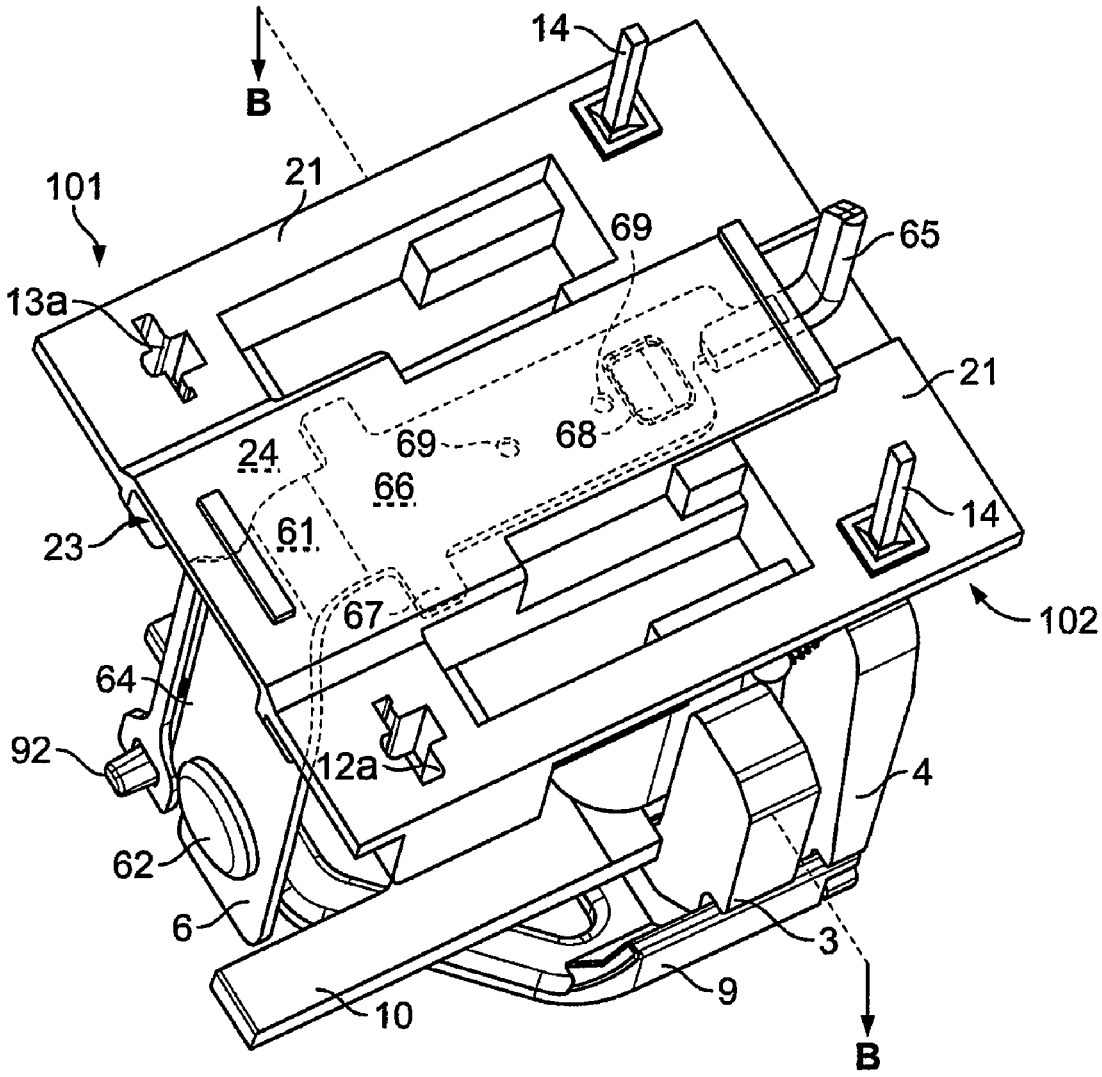
FIG. 5 is a perspective view of a bottom of the relay of FIG. 2.

As shown in FIG. 4, the relay 1 includes a contact arrangement consisting of stationary contact springs 5, 7 and the moveable contact spring 6. As shown in FIGS. 4-5, the stationary and moveable contact springs 5, 6, 7 are arranged next to one another along a first side 101 of the main body 2. The stationary contact springs 5, 7 may be of substantially identical construction. As shown in FIGS. 3-5, the stationary contact spring 5 is anchored in an insertion slot 13*a* in a pedestal attachment 13 arranged on the base 21 of the main body 2 and has a terminal contact 53 extending out of the main body 2 of the relay 1. The stationary contact spring 7 is anchored in an insertion slot 12*a* in a pedestal attachment 12 arranged on the base 21 of the main body 2 and has a terminal contact 73 extending out of the main body 2 of the relay 1. As shown in FIG. 4, each of the stationary contact springs 5, 7 is provided with a contact zone 71 (only the contact zone 71 of the stationary contact 7 is shown). Each of the stationary contact springs 5, 7 has a substantially L-shaped end portion 52, 72, respectively. The end portions 52, 72 are formed to mutually overlap. As shown in FIG. 3, the end portion 52 of the stationary contact spring 5 rests against a limit stop 11 of the main body 2, and the end portion 72 of the stationary contact spring 7 rests against a limit stop 10 of the main body 2.

As shown in FIG. 3, the moveable contact spring 6 extends substantially perpendicular to the actuating member 9 and the base 21 of the main body 2 and substantially parallel to a lengthwise axis of the coil 22. The moveable contact spring 6 has a first contact zone 62 provided on a first portion 64, and a restoring spring arm 63 formed in one piece with the moveable contact spring 6 and decoupled therefrom. The restoring spring arm 63 has an opening 63*a* formed therein. As shown in FIG. 5, the moveable contact spring 6 extends along the base 21 of the main body 2 in a partly closed channel 23 from the first side 101 of the main body 2 where the stationary contact springs 5, 7 are arranged to an opposing second side 102 of the main body 2. The moveable contact spring 6 extends in a first direction on the first side 101 of the main body 2 and in a second direction in a second portion 66 from the first side 101 to the opposing second side 102 of the main body 2, which second direction is arranged substantially parallel to the base 21 of the main body 2 and substantially perpendicularly to the first direction. The moveable contact spring 6 assumes in cross-section a substantially S-shaped or Z-shaped configuration.

Figure 6:
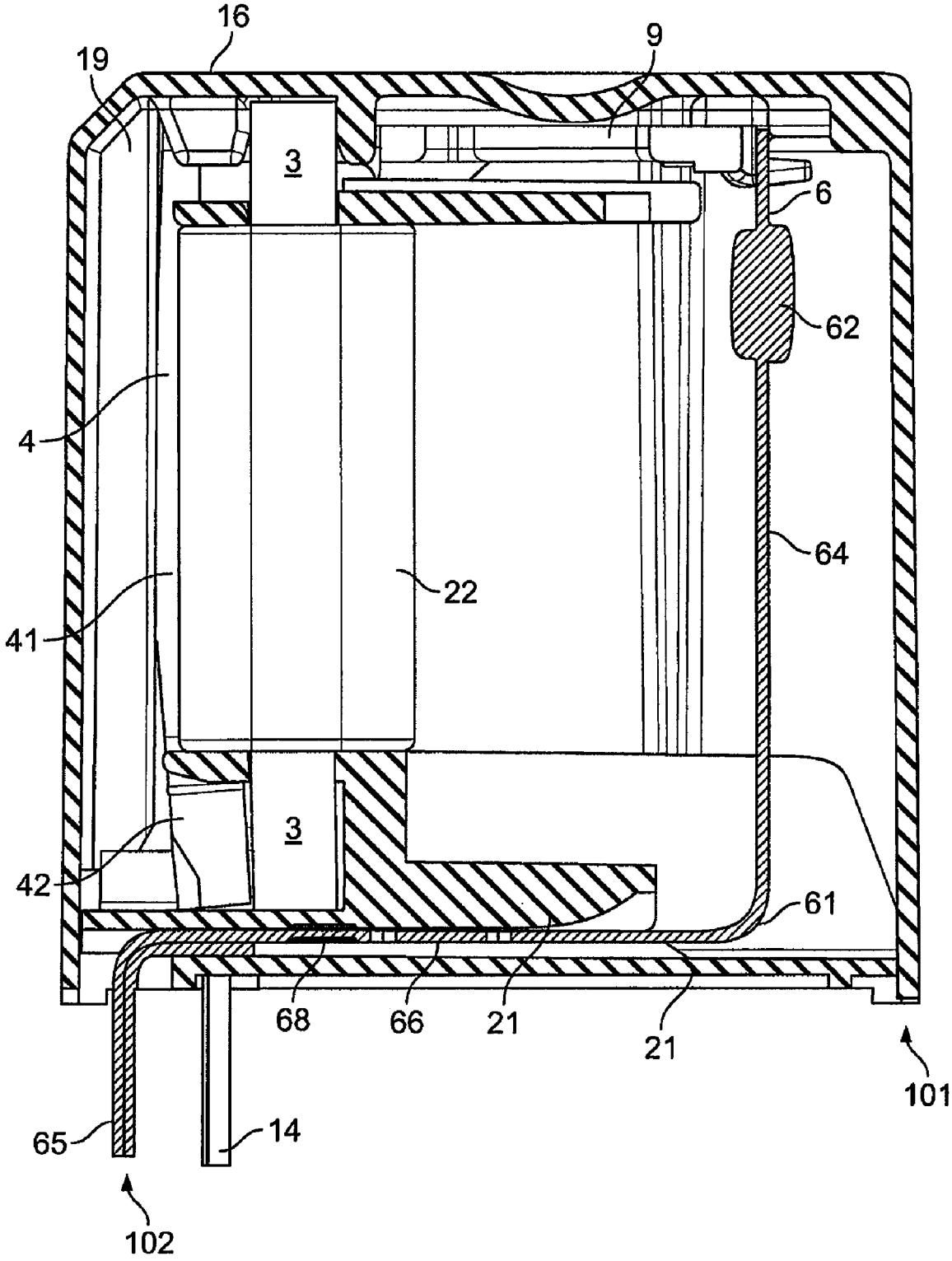
FIG. 6 is sectional view of the relay of FIG. 2 taken along line A-A in FIG. 3.
Figure 7:
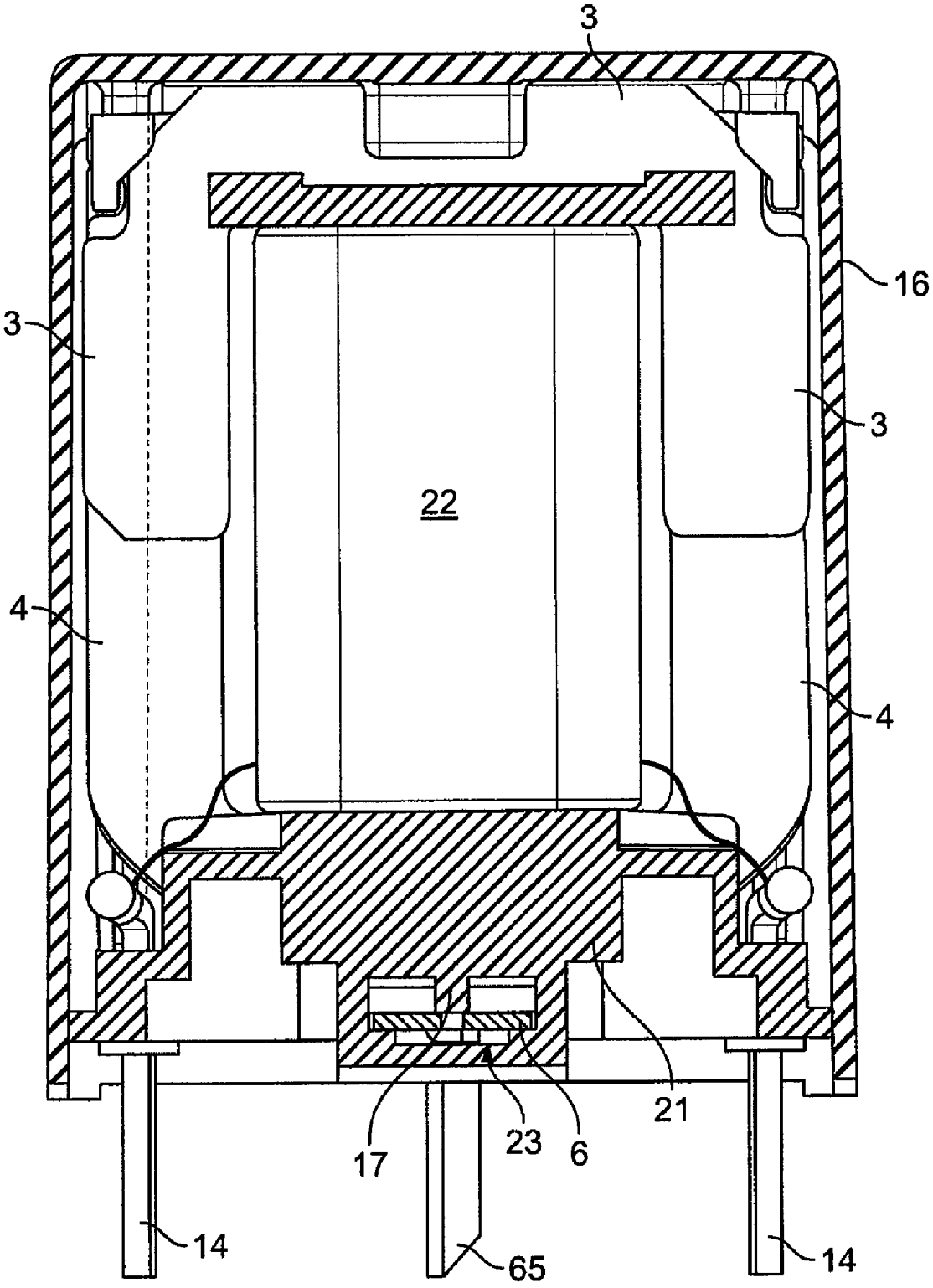
FIG. 7 is sectional view of the relay of FIG. 2 taken along line B-B in FIG. 5.

In a portion 61, the moveable contact spring 6 develops into the second portion 66, which is guided in the channel 23 and extends approximately from the first side 101 of the main body 2 to the opposing second side 102 of the main body 2. As shown in FIG. 6, the moveable contact spring 6 is guided past the core 3, the coil 22, and the armature 4 of the relay 1 via the second portion 66. As shown in FIGS. 5 and 7, the channel 23 has a bearing surface 24 and a web 17, which secures the moveable contact spring 6 in the channel 23. The web 17 is constructed in the base 21 of the main body 2 and is arranged in such a way that the moveable contact spring 6 is pressed, within the second portion 66, onto the bearing surface 24 of the main body.

The lengthwise extent of the second portion 66 is approximately parallel to the lengthwise extent of the base 21 of the main body 2 and is arranged approximately perpendicularly to the lengthwise extent of the first portion 64 of the moveable contact spring 6. As shown in FIG. 5, the second portion has a fixing zone 68. The fixing zone 68 is a thickened portion and serves to fix the moveable contact spring 6 in the base 21 of the main body 2 with an interference fit. Openings 69 are provided in the second portion 66 to allow for a surrounding plastic material to enter the openings 69 and further fix the moveable contact spring 6 in the base 21 of the main body 2. Two opposing extensions 67 on the second portion 66 serve as limit stops for positioning the moveable contact spring 6 in the channel 23 in the base 21 of the main body. A terminal contact 65 of the moveable contact spring 6 is formed on the opposing second side 102 of the main body 2 for external connection of the relay 1. The terminal contact 65 extends substantially parallel to the lengthwise extent of the first portion 64 and substantially perpendicularly to a direction in which the second portion 66 extends.

As shown in FIG. 6, the armature 4 has a pivot 41 that strikes a rib 19 of the external housing 16 to produce a lever action which is exerted on a mounted end 42 of the armature 4. By means of the pivot 41, the mounted end 42 of the armature 4 is thereby forced into and against a bottom end portion of the core 3. This results in reproducible flux transition conditions in the armature mounting and correspondingly low pickup.

As shown in FIG. 3, an extension 92 of the actuating member 9 is engaged in the opening 63*a* of the restoring spring arm 63. The moveable spring contact 6 is thereby moved by the actuating member 9 between a normal position and a contact position. The restoring spring arm 63 biases the moveable spring contact 6 into the normal position by exerting a spring force on the actuating member 9 such that the armature 4 is biased by the restoring force of the moveable contact spring 6 via the actuating member 9 into the normal position.

Upon actuation of the actuating member 9 by the armature 4, the contact zone 62 of the moveable contact spring 6 is moved towards and into electrical contact with the contact zone 71 of the stationary contact spring 7. In the normal position, the contact zone 62 of the moveable contact spring 6 rests against the end portion 52 of the stationary contact spring 5. After overcoming a gap, the projection 93 of the actuating member 9 moves the moveable contact spring 6 out of the normal position and into the contact position. Thus, the moveable contact spring 6, as well as the stationary contact springs 5, 7 are guided along the first side 101 of the main body 2 approximately parallel to a coil axis of the coil 22.

As shown in FIG. 5, terminal contacts 14 extend from the coil 22. The terminal contact 65 of the moveable contact spring 6 is located between the terminal contacts 14 of the coil 22. The terminal contacts 14 extend in a plane substantially perpendicular to the base 21 of the main body 2. The terminal contacts 14 are connected to the coil 22 via terminals 15, as shown in FIG. 3. The terminal contact 65 of the moveable contact spring 6 is slightly offset out of the plane of the terminal contacts 14.

Figure 1:
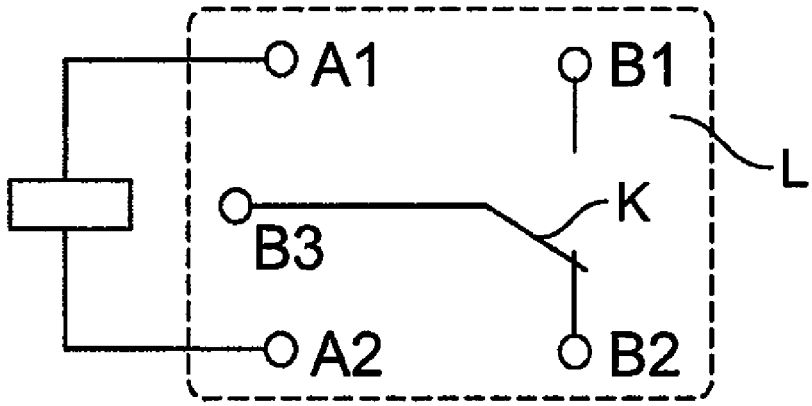
FIG. 1 is a schematic illustration of a printed circuit board for connection of a relay according to an embodiment of the invention.

The relay 1 may be mounted on a printed circuit board L, as shown in FIG. 1, which is commonly used with a relay of the so-called "sugar cube" design. The printed circuit board L comprises pads or terminal fields A1, A2, terminal fields B1, B2, a terminal field B3, and a changeover contact K. The terminal contacts 14 of the coil 22 are electrically connected with the terminal fields A1, A2. The terminal contact 53 of the stationary contact spring 5 may be connected to the terminal field B1. The terminal contact 73 of the stationary contact spring 7 is connected to the terminal field B2. The terminal contact 65 of the moveable contact spring 6 is connected to the terminal field B3. The relay 1 according to an embodiment of the invention therefore makes it possible to equip the printed circuit board L with a relay which is of a design that is cheaper to produce than a relay of the so-called "sugar cube" design.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A relay, comprising:

a main body with a base;

an electromagnetic switching mechanism arranged on the base, the electromagnetic switching mechanism comprises a coil, a core, and an armature;

a contact arrangement including at least one stationary contact spring and at least one moveable contact spring, the stationary contact spring and the moveable contact spring being arranged on a first side of the main body; and the moveable contact spring having a first portion extending substantially perpendicular to the base the contact spring being actuatable by the electromagnetic switching mechanism and a second portion extending substantially parallel to the base in a partly closed channel from the first side of the main body where the at least one stationary contact spring is arranged to an opposing second side of the main body past the core, the coil, and the armature, and a terminal contact extending from the second portion on the second side of the main body, the terminal extending parallel to a lengthwise extent of the first portion and substantially perpendicularly to a direction in which the second portion extends.

2. The relay of claim 1, wherein the channel extending from the first side to the second side of the main body includes a bearing surface and a web, which secures the moveable contact spring in the channel.

3. The relay of claim 1, wherein the stationary contact spring has a terminal contact extending therefrom on the first side of the main body.

4. The relay of claim 3, wherein the electromagnetic switching mechanism has terminal contacts extending therefrom on the second side of the main body.

5. The relay of claim 4, wherein the terminal contacts of the electromagnetic switching mechanism extend in a plane substantially perpendicular to the base, the terminal contact of the moveable contact spring being offset from the plane of the terminal contacts of the electromagnetic switching mechanism.

6. The relay of claim 1, wherein the electromagnetic switching mechanism is arranged between the first side and the second side of the main body.

7. The relay of claim 6, wherein the electromagnetic switching mechanism includes an actuating member.

8. The relay of claim 7, wherein the coil is arranged substantially perpendicular to the base.

9. The relay of claim 1, wherein the moveable contact spring is fixed to the base between the first side and the second side of the main body.

10. The relay of claim 1, wherein the moveable contact spring is fixed to the base by a thickened portion of the moveable contact spring.

11. The relay of claim 1, wherein the electromagnetic switching mechanism includes an actuating member that actuates the moveable contact spring between a normal position and a contact position, the actuating member being moveable substantially parallel to the base.

12. The relay of claim 11, wherein a restoring spring arm extends from the first portion of the moveable contact arm and is decoupled therefrom, the restoring spring arm engaging the actuating member such that the restoring spring arm bias the moveable contact spring into the normal position.

13. The relay of claim 1, wherein the stationary contact spring includes an end portion with a contact zone aligned with a first contact zone of the moveable contact, the end portion having a substantially L-shape.

14. The relay of claim 13, wherein the main body includes a limit stop, the end portion of the stationary contact spring resting against the limit stop.

15. The relay of claim 10, further comprising at least an opening in the second portion of the moveable contact spring.

16. The relay of claim 15, wherein the moveable contact spring is further fixed to the base by applying a surrounding plastic material into the at least an opening in the second portion.

* * * * *